US005326193A

United States Patent [19]

Peterson

[11] Patent Number: 5,326,193

[45] Date of Patent: Jul. 5, 1994

[54] INTERLOCKING RETAINING WALL APPARATUS

[76] Inventor: Daryl L. Peterson, P.O. Box 407, N. Bonneville, Wash. 98639

[21] Appl. No.: 23,350

[22] Filed: Feb. 25, 1993

[51] Int. Cl.[5] ..... E02D 3/02

[52] U.S. Cl. ..... 405/286; 405/284; 405/272

[58] Field of Search ..... 405/262, 284, 286, 285, 405/272, 258, 25

[56] References Cited

U.S. PATENT DOCUMENTS

| | | | |
|---|---|---|---|
| 2,260,570 | 10/1941 | John . | |
| 2,545,320 | 3/1951 | Tilson et al. . | |
| 2,555,455 | 6/1951 | Platt . | |
| 2,626,078 | 1/1953 | Hutchisson, Jr. et al. . | |
| 2,650,786 | 9/1953 | Platt . | |
| 2,683,579 | 7/1954 | Wallace . | |
| 2,841,351 | 7/1958 | Riepen . | |
| 3,173,469 | 6/1964 | Stanley . | |
| 3,201,075 | 8/1965 | Sievers . | |
| 3,224,595 | 12/1965 | Sherley . | |
| 3,272,466 | 9/1966 | Sherman . | |
| 3,310,266 | 3/1967 | Larkin et al. . | |
| 3,471,114 | 10/1969 | Ball . | |
| 4,609,901 | 9/1986 | Hamm . | |
| 4,798,499 | 1/1989 | Yamada | 405/262 X |
| 4,905,945 | 3/1990 | Peterson . | |
| 4,920,712 | 5/1990 | Dean, Jr. | 405/262 X |
| 5,044,834 | 9/1991 | Janopaul, jr. | 405/262 X |
| 5,046,898 | 9/1991 | McKinney | 405/284 X |
| 5,056,961 | 10/1991 | McMeans et al. | 405/284 |
| 5,174,688 | 12/1992 | Meheen | 405/262 X |
| 5,214,898 | 6/1993 | Beretta | 405/284 X |

FOREIGN PATENT DOCUMENTS

| | | |
|---|---|---|
| 595176 | 3/1960 | Canada . |
| 1304703 | 8/1962 | France . |

*Primary Examiner*—Randolph A. Reese
*Assistant Examiner*—J. Russell McBee
*Attorney, Agent, or Firm*—Kolisch Hartwell Dickinson McCormack & Heuser

[57] ABSTRACT

An interlocking retaining wall apparatus includes a collection of plural, annular structures which frictionally interlock with one another to form a wall. The structures making up the wall have a generally truncated, right conical exterior surface and a generally right, cylindrical interior surface. The structures are stacked, one atop the other, to form a wall of desired height. A variety of sizes of structures are provided to meet the needs of the individual wall which is being constructed.

21 Claims, 2 Drawing Sheets

INTERLOCKING RETAINING WALL APPARATUS

BACKGROUND AND SUMMARY OF THE INVENTION

The present invention relates generally to retaining walls, and specifically to an interlocking apparatus for forming a retaining wall.

Many forms of retaining walls are known. Perhaps the most common is the conventional concrete cast block which are assembled in a brick-like fashion and are filled with concrete and/or rebar, or perhaps are earth filled. Such retaining walls, while functional, are not particularly aesthetic.

Another well-known form of retaining wall is built of conventional bricks. Such a retaining wall may be desirable because of the warmth that it adds to the property on which it is located, however, the costs of such a wall is quite expensive.

Other forms of retaining walls may incorporate railroad ties or other large structural elements.

It is an object of the invention to provide an apparatus which will allow the construction of retaining walls which are aesthetically pleasing, functional and durable.

Another object of the invention is to provide a retaining wall apparatus which will allow construction of retaining walls having geometries which are adaptable to any terrain.

A further object of the invention is to provide a retaining wall apparatus which maintains a retaining force normal to the terrain being retained.

Yet another object of the invention is to provide a retaining wall apparatus which is durable, relatively inexpensive and easily installed.

The retaining wall of the instant invention utilizes a collection of plural, annular structures which frictionally interlock with one another to form a wall. The structures making up the wall have a generally truncated, right conical exterior surface and a generally right, cylindrical interior surface. The structures are stacked, one atop the other, to form a wall of desired height. A variety of sizes of structures are provided to meet the needs of the individual wall which is being constructed. Additionally, walls make be constructed with a variety of geometries using the apparatus of the invention.

These and other objects and advantages of the present invention will be more readily understood after consideration of the drawings and the detailed description of the preferred embodiment.

DETAILED DESCRIPTION OF THE PREFERRED EMBODIMENT

Figure 2:
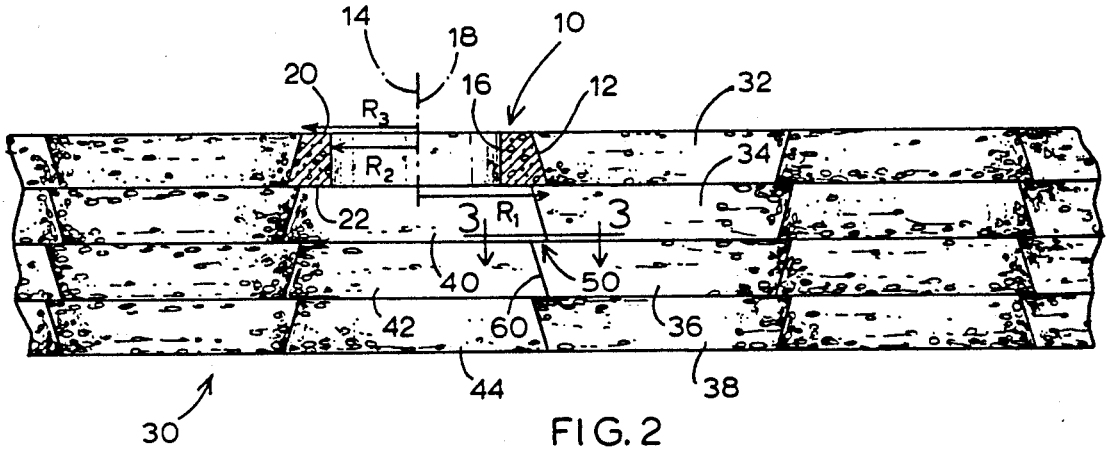
FIG. 2 is front elevation of a first form of a retaining wall constructed according to the invention, an includes a medial section of the annular structure of FIG. 1.
Figure 1:
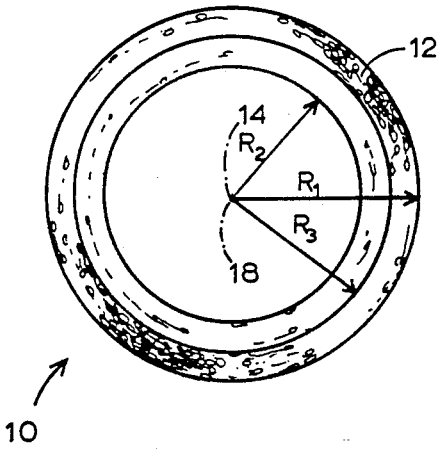
FIG. 1 is a top plan view of an annular structure of the invention.

Referring now to FIGS. 1 and 2, an annular structure of the invention is depicted generally at 10. In the preferred embodiment, structure 10 is a cast concrete annulus having a truncated, generally right-conical exterior surface 12 having an axis 14, and a generally right-cylindrical interior surface 16 having an axis 18, wherein axes 14 and 18 are coincident. The annular concrete members described and illustrated herein are circular, but it will be understood that alternative annular shapes, for example, ovals or other curvilinear shapes, are within the scope of the invention.

Each annular structure also includes a flat top surface 20 and a flat bottom surface 22. The top and bottom surfaces are substantially normal to axes 14, 18. The top and bottom surfaces, and the truncated conical exterior surface are constructed and arranged such that when two annular structures are stacked one atop another, the flat top surface of the lower annular structure underlies, and is at least partly covered by, the flat bottom surface of the upper annular structure. This is accomplished by providing a radius for the juncture of the truncated, conical exterior surface with the bottom surface of $R_1$and a juncture of the flat upper surface with the right cylindrical interior surface of $R_2$, and setting the juncture of the flat top surface with the exterior surface of $R_3$, wherein $R_1$is greater than $R_3$ is greater than $R_2$.

The annular structures may be formed of smooth cast concrete, or may be formed with an aggregate mixed within the concrete to form a pebbled appearance. The choice of materials is largely determined by the aesthetic appearance which is desired to be achieved by using the annular structures in a retaining wall.

Referring now to FIG. 2, one form of interlocking retaining wall apparatus constructed according to the invention is depicted generally at 30. Apparatus 30 includes plural annular structures such as structure 10, and like formed structures, indicated at 32, 34, 36, 38, 40, 42 and 44. As depicted in FIG. 2, structures 10 and 32, 34 and 40, 36 and 42, and 38 and 44 are parts of four separate, horizontally extending rows, each of which is stacked vertically on a lower row (or on a supporting surface, for example, the ground).

Each annular structure is arranged in the wall to be in frictional engagement with at least one other annular structure. As previously noted, one consideration for the choice of materials used in forming the annular structures relates to the aesthetic features of the finished wall. Another factor in the choice of material used in the construction of the annular structures is related to the amount of friction which is required to be present between adjacent, frictionally engaged annular structures. The rougher the surface, such as when an aggregate is used, the greater the frictional engagement. When smooth surface concrete is used, there is less frictional engagement.

Figure 3:
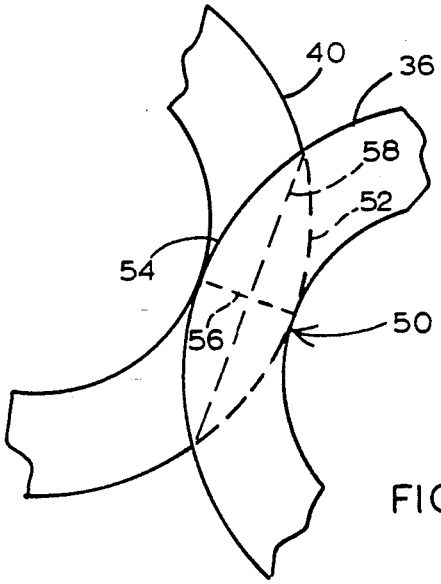
FIG. 3 is a greatly enlarged, top plan view of an overlay surface of the invention.

Referring now to FIGS. 2 and 3, what is referred to herein as an adjacent overlay surface is depicted generally at 50. Overlay surface 50 is formed by the intersection of a portion of bottom surface 22 of, in this instance, annular structure 40 and annular structure 36. Annular structure 40 partially overlays annular structure 36, which is located in an adjacent vertical row and is laterally adjacent thereto, defining surface 50. Surface 50 has, in turn, two curved sides, 52, 54, a minor axis 56 and a major axis 58. In the preferred embodiment, whenever an overlay surface is defined, the major and minor axis thereof are normal to one another.

A wall constructed according to the invention will include many annular structures, and if installed according to the first embodiment depicted in FIG. 2, will also include many overlay surfaces. For each overlay surface, the major axis thereof will be oriented normal to the terrain, or mass, which is being retained, and hence, will be normal to the forces which are applied to the retaining wall by the terrain. The minor axes of the overly surfaces will define the preferably generally horizontal run of the wall, regardless of whether the run is straight or curved. These features will be more fully described later herein.

Still referring to FIG. 2, it may be seen that where the annular structures which are located in a horizontal row are in contact with one another, such contact is along a line, such as line 60 between annular structures 42 and 46, and is referred to herein as line contact. Referring to FIG. 2 and to annular structures 10 and 40, the relationship between inferior and superior annular structures is depicted. When the annular structures are stacked in a vertical column, or rank, the flat top surface 20 of an inferior annular structure 40 underlies, and is partly covered by, the flat bottom surface 22 of the superior annular structure 10.

Figure 4:
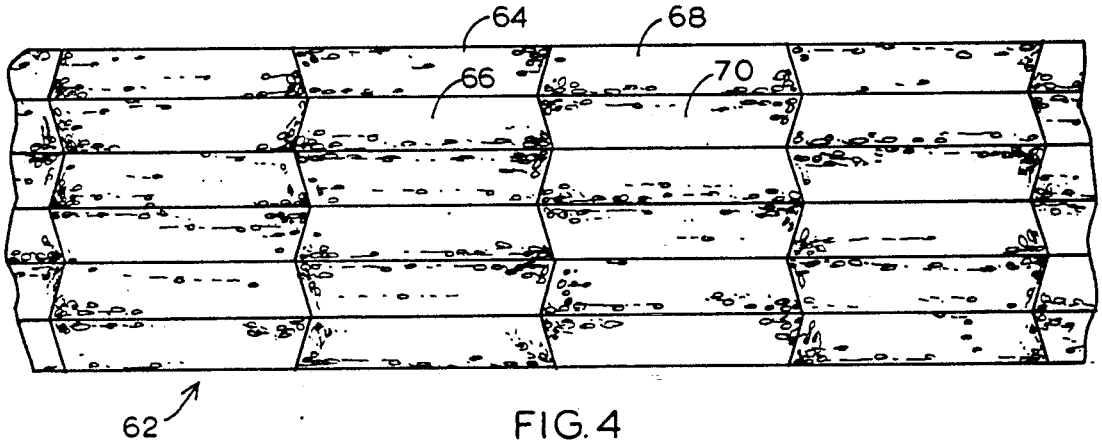
FIG. 4 is a front elevation of an alternative embodiment of a retaining wall constructed according to the invention.

In the embodiment depicted in FIG. 4, retaining wall apparatus 62 is constructed such that all contact between adjacent annular structures, such as structures 64, 66, 68 and 70 is line contact. In this embodiment, there are no adjacent overlay surfaces defined, and any frictional engagement is present in vertical rows and at the line contact area between laterally adjacent annular structures.

Figure 5:
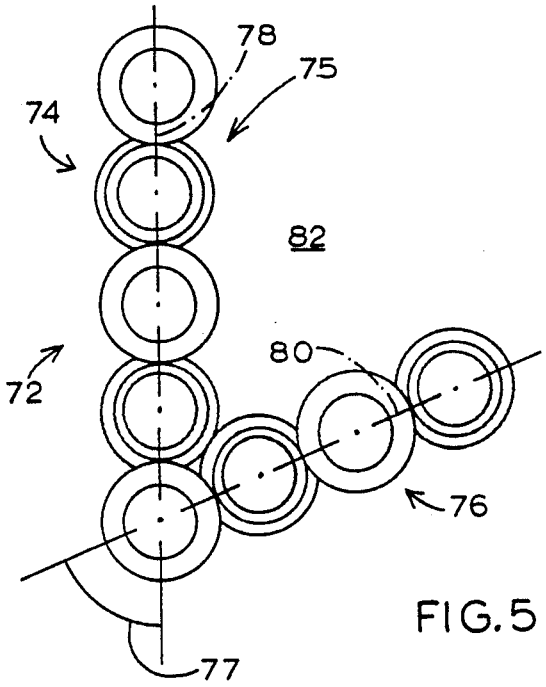
FIGS. 5–7 are top plan views of a variety of wall geometries constructed with the apparatus of the invention.

Referring now to FIG. 5, a wall 72 includes a run 74 of annular structures, which have overlay surfaces formed therebetween. Run 74 includes two run arms 75, 76, which form an angle 77 therebetween. Referring to FIG. 3 in addition to FIG. 5, it may be seen that minor axes 56 of overlay surfaces 50 extend collinearly with, or parallel to, an axis 78 of run arm 74 and axis 80 of run arm 76. Further, the major axes 58 extend normal to such run arm axes and, on one side of the wall which retains the supported terrain, or mass, 82, the major axes are normal to the outward forces generated by the supported terrain. Thus, the terrain-generated lateral forces act in line with, or parallel to, the major axes of the overlay surfaces, which constitute the stronger regions of the wall.

Figure 6:
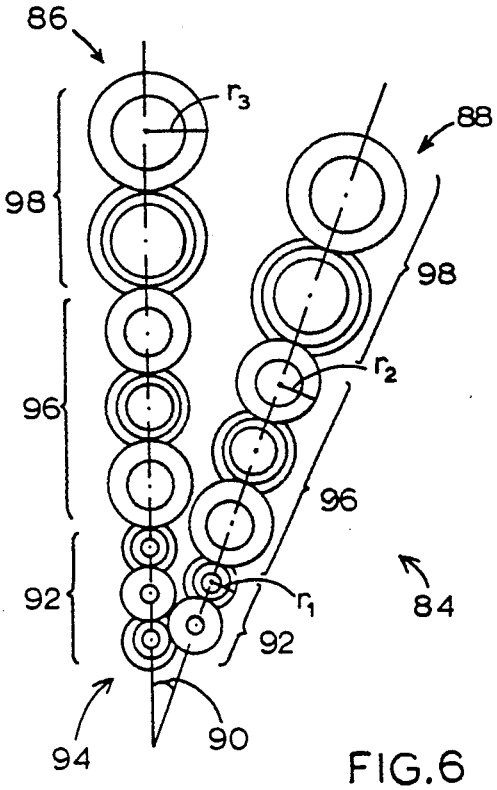

FIG. 6 depicts a wall 84 constructed along run arms 86, 88. In this embodiment, an angle 90 is formed between the run arms. Angle 90 is acute in nature, and requires a sharper turn than may be accomplished using the annular structures depicted in FIG. 5. To accomplish a sharp angle turn in a run, annular structures having relatively smaller radii are used. In the wall apparatus depicted in FIG. 6, a first group 92 of annular structures forms the point 94 of the wall apparatus. Such structures have a radius, for example, of $r_1$. A second group 96 of annular structures have a radius of $r_2$, while a third group 98 of annular structures have a radius of $r_3$.

Figure 7:
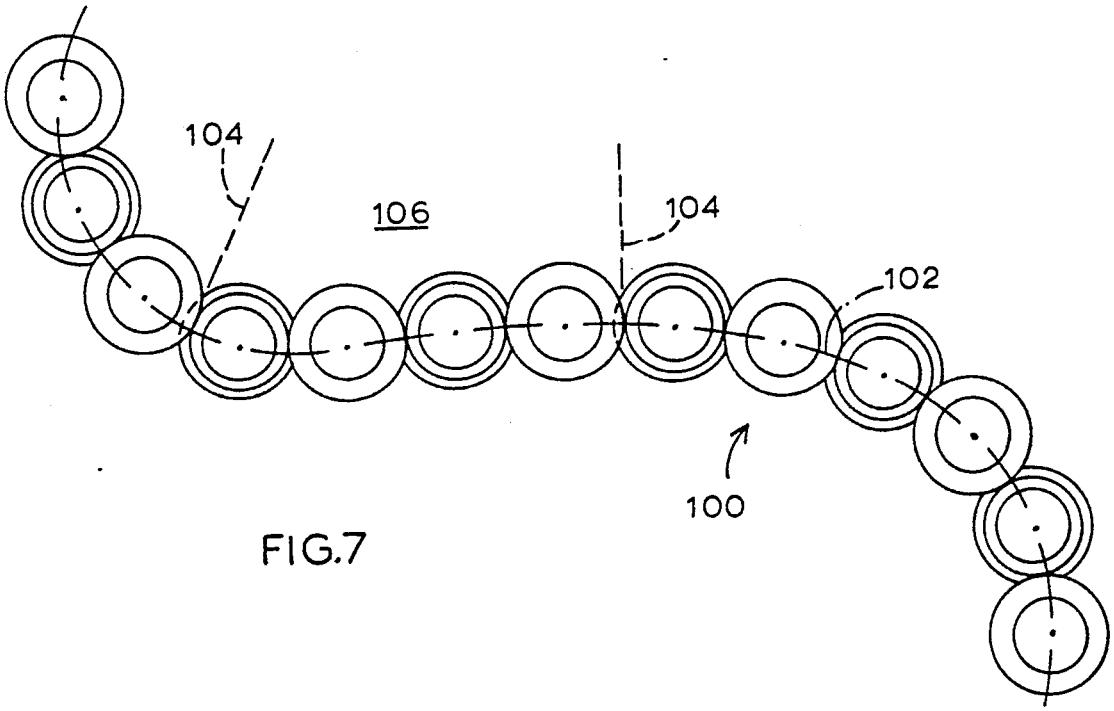

Referring now to FIG. 7, a wall apparatus 100 has a curved run 102 which follows the piece-wise curvilinear minor axes 56 of overlay surfaces 50. Extensions 104 of the major axes 58 of the overlay surface extend normal to run 102 at corresponding points therealong and into supported terrain 106, thereby providing support for the terrain.

In instances where the wall is arranged to be more than two or three tiers, or rows, high, it may be appropriate to secure the annular structures in place with rebar, and/or to provide a poured concrete center. It has been found, however, that the invented apparatus typically does not require such reinforcement, and that a simple, earth-filled wall most often provides the required lateral force-withstand capability.

Accordingly, although a preferred embodiment of the invention, and a variation thereof has been described, it will be appreciated by those skilled art that other changes in form and detail may be made therein without departing from the spirit of the invention as defined in the appended claims.

I claim:

1. An interlocking retaining wall apparatus comprising:

plural annular structures constructed and arranged to interlock with one another to form a wall, each annular structure having a generally truncated right-conical exterior surface including an axis therefor, a generally right-cylindrical interior surface including an axis therefor, wherein said axis for said interior surface is coincident with said axis for said exterior surface, and wherein each of said annular structures includes a flat top surface and a flat bottom surface, said top and said bottom surfaces being constructed and arranged to be substantially normal to said axes;

said plural annular structures being arranged, at least two structures high, in frictional engagement with vertically and laterally adjacent annular structures, to provide a wall which is substantially free of gaps when viewed from the side thereof.

2. The interlocking retaining wall apparatus of claim 1 wherein said annular structures are constructed and arranged such that, when stacked on top of another, said flat top surface of an inferior annular structure underlies, and is at least partly covered by, said flat bottom surface of a superior annular structure.

3. The interlocking retaining wall apparatus of claim 1 wherein said annular structures are arranged in horizontally extending rows and wherein a row is stacked vertically on a lower row, and wherein a laterally adjacent annular structure located in an adjacent vertical row partially overlay another such annular structure in another row, defining an adjacent overlay surface, said overlay surface having at least two curved sides thereto.

4. The interlocking retaining wall apparatus of claim 3 wherein each overlay surface includes a minor axis and a major axis and wherein said axes are normal to one another.

5. The interlocking retaining wall apparatus of claim 4 wherein the retaining wall retains a supported mass which exerts a force on the wall apparatus, and wherein each of said major axes extends parallel to said force, and wherein each of said minor axes extends normal to said force.

6. The interlocking retaining wall apparatus of claim 5 wherein said annular structures are arranged in said wall in a wall run, and wherein said minor axes extend parallel to said wall run.

7. The interlocking retaining wall apparatus of claim 4 wherein said annular structures are provided having a variety of radii, and wherein said wall run is formed into a relatively small acute angle by arranging relatively small dimension radii annular structures at the location of said relatively small acute angle.

8. The interlocking retaining wall apparatus of claim 7 wherein said minor axes extend collinearly with said wall run.

9. The interlocking retaining wall apparatus of claim 3 wherein said annular structures located in a row contact one another along a line where their respective exterior surfaces meet.

10. The interlocking retaining wall apparatus of claim 1 wherein the exterior surface, top surface and bottom surface of each of said annular structures are textured to promote frictional engagement with adjacent annular structures.

11. An interlocking retaining wall apparatus comprising:

plural annular structures constructed and arranged to interlock with one another to form a wall, each annular structure having a generally truncated right-conical exterior surface including an axis therefor, a generally right-cylindrical interior surface including an axis therefor, wherein said axis for said interior surface is coincident with said axis for said exterior surface, and wherein each of said annular structures includes a flat top surface and a flat bottom surface, said top and said bottom surfaces being constructed and arranged to be substantially normal to said axes;

said plural annular structures being arranged, at least two structures high, in frictional engagement with vertically and laterally adjacent annular structures, to provide a wall which is substantially free of gaps when viewed from the side thereof, wherein said annular structures are constructed and arranged such that, when stacked on top of another, said flat top surface of an inferior annular structure underlies, and is at least partly covered by, said flat bottom surface of a superior annular structure.

12. The interlocking retaining wall apparatus of claim 11 wherein said annular structures are arranged in horizontally extending rows and wherein a row is stacked vertically on a lower row, and wherein a laterally adjacent annular structure located in an adjacent vertical row partially overlay another such annular structure in another row, defining an adjacent overlay surface, said overlay surface having at least two curved sides thereto.

13. The interlocking retaining wall apparatus of claim 12 wherein said overlay surface includes a minor axis and a major axis and wherein said axes are normal to one another.

14. The interlocking retaining wall apparatus of claim 13 wherein the retaining wall retains a supported mass which exerts a force on the wall apparatus, and wherein each of said major axes extends parallel to said force, and wherein each of said minor axes extends normal to said force.

15. The interlocking retaining wall apparatus of claim 14 wherein said annular structures are arranged in said wall in a wall run, and wherein said minor axes extend parallel to said wall run.

16. The interlocking retaining wall apparatus of claim 13 wherein said annular structures are provided having a variety of radii, and wherein said wall run is formed into a relatively small acute angle by arranging relatively small dimension radii annular structures at the location of said relatively small acute angle.

17. The interlocking retaining wall apparatus of claim 13 wherein said minor axes extend collinearly with said wall run.

18. The interlocking retaining wall apparatus of claim 13 wherein said annular structures located in a row contact one another along a line where their respective exterior surfaces meet.

19. The interlocking retaining wall apparatus of claim 11 wherein the exterior surface, top surface and bottom surface of each of said annular structures are textured to promote frictional engagement with adjacent annular structures.

20. An interlocking retaining wall apparatus arranged along a wall run, for retaining a supported mass which exerts a force on the wall apparatus comprising:

plural annular structures constructed and arranged to interlock with one another to form a wall, each annular structure having a truncated generally right-conical exterior surface including an axis therefor, a generally right-cylindrical interior surface including an axis therefor, wherein:

said axis for said interior surface is coincident with said axis for said exterior surface;

each of said annular structures includes a flat top surface and a flat bottom surface, said top and said bottom surfaces being constructed and arranged to be substantially normal to said axes;

said annular structures are arranged in the apparatus such that, when stacked on top of another, said flat top surface of an inferior annular structure underlies, and is at least partly covered by, said flat bottom surface of a superior annular structure;

said annular structures are arranged in horizontally extending rows wherein a row is stacked vertically on a lower row and a laterally adjacent annular structure located in an adjacent vertical row partially overlays another such annular structure in another row, defining an adjacent overlay surface, said overlay surface having at least two curved sides thereto, wherein each overlay surface includes a minor axis and a major axis and wherein said axes are normal to one another; wherein each of said major axes extends parallel to said force, and wherein each of said minor axes extends normal to said force and extend parallel to the wall run; and said plural annular structures being arranged, at least two structures high, in frictional engagement with vertically and laterally adjacent annular structures, to provide a wall which is substantially free of gaps when viewed from the side thereof.

21. The interlocking retaining wall apparatus of claim 20 wherein said annular structures are provided having a variety of radii, and wherein said wall run is formed into a relatively small acute angle by arranging relatively small dimension radii annular structures at the location of said relatively small acute angle.

* * * * *